United States Patent [19]

Kuhn et al.

[11] Patent Number: 4,688,401

[45] Date of Patent: Aug. 25, 1987

[54] YARN FEEDING AND GUIDE DEVICE FOR A KNITTING MACHINE

[75] Inventors: Falk Kuhn, Kiebingen; Alfred Buck, Rottenburg, both of Fed. Rep. of Germany

[73] Assignee: Memminger GmbH, Freudenstadt, Fed. Rep. of Germany

[21] Appl. No.: 625,516

[22] Filed: Jun. 28, 1984

[30] Foreign Application Priority Data

Jul. 6, 1983 [DE] Fed. Rep. of Germany ..... 3324245

[51] Int. Cl.[4] ..... D04B 15/54

[52] U.S. Cl. ..... 66/141; 66/111; 66/125 R; 66/136

[58] Field of Search ..... 66/111, 136, 141, 142, 66/143, 144, 125 R; 242/15 T R

[56] References Cited

U.S. PATENT DOCUMENTS

| | | | |
|---|---|---|---|
| 130,866 | 8/1872 | Ramsdell | 66/141 X |
| 824,403 | 6/1906 | Boas | 66/141 X |
| 2,616,276 | 11/1952 | Miller | 66/136 |
| 2,690,313 | 9/1954 | McDermott | 242/157 R |
| 3,245,624 | 4/1966 | Meyers et al. | 242/157 R X |
| 3,529,442 | 9/1970 | Gelber et al. | 66/141 X |
| 3,590,601 | 7/1971 | Sugiura | 66/136 X |
| 3,800,564 | 4/1974 | Carswell | 66/136 |
| 3,918,135 | 11/1975 | Kim | 66/125 R X |
| 3,918,275 | 11/1975 | Paepke | 66/146 X |

FOREIGN PATENT DOCUMENTS

| | | | |
|---|---|---|---|
| 2014229 | 10/1970 | Fed. Rep. of Germany . | |
| 2156355 | 5/1972 | Fed. Rep. of Germany . | |
| 2457702 | 6/1976 | Fed. Rep. of Germany | 66/125 R |
| 32318 | 11/1927 | France | 242/157 R |
| 26-14543 | 12/1951 | Japan . | |
| 395519 | 7/1933 | United Kingdom . | |
| 1363465 | 8/1974 | United Kingdom . | |
| 1536664 | 12/1978 | United Kingdom . | |
| 111708 | 5/1959 | U.S.S.R. . | |
| 785168 | 12/1980 | U.S.S.R. . | |

*Primary Examiner*—Wm. Carter Reynolds

*Attorney, Agent, or Firm*—Frishauf, Holtz, Goodman & Woodward

[57] ABSTRACT

A yarn feeding and guide device for knitting machines has at least one yarn feeder, which delivers the yarn arriving from a yarn package and being supplied as needed at a predetermined tension by a yarn delivery unit or fournisseur to the needles of a row of needles. The yarn feeder is disposed in a stationary manner on the machine such that it does not contact the needles of the needle row, and yarn guide elements located in the path of the yarn are associated with it. In order to obtain gentle handling of the yarn, in particular in the vicinity of the yarn feeder, and to attain easy manipulation of the yarn feeding and guide device, the arrangement is such that the yarn feeder has at least one open yarn guide groove formed on the circumference of a yarn feeder body provided with a securing device, and the bottom of this guide groove is curved in an arc—as viewed in the direction of yarn travel—and the yarn can be deflected in this guide groove into a direction extending obliquely with respect to the needles.

28 Claims, 21 Drawing Figures

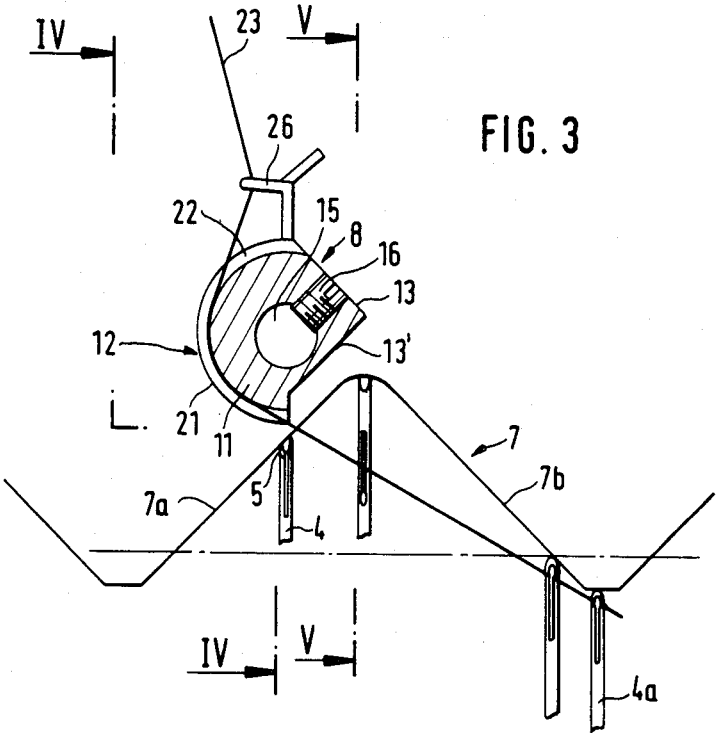
FIG. 3
FIG. 4
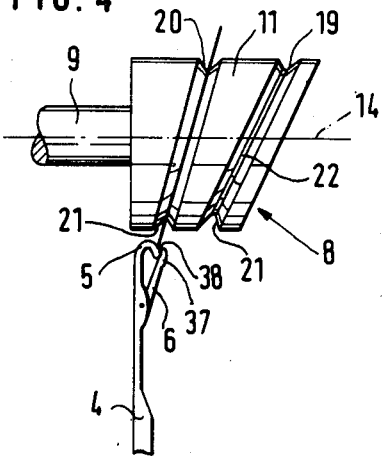
FIG. 5
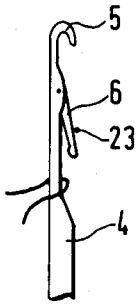

YARN FEEDING AND GUIDE DEVICE FOR A KNITTING MACHINE

The present invention relates to a yarn feeding and guide device for a knitting machine, particularly a circular knitting machine, in which the yarn arriving from a yarn package, which may be delivered by a yarn supply apparatus or fournisseur and is held at a predetermined tension, is fed by at least one yarn feeder to the needles of a row of needles. The yarn feeder is disposed on the machine such that it is stationary and does not touch the needles of the needle row, and yarn guide elements located in the yarn path are associated with it.

BACKGROUND

Known circular knitting machines are all equipped with yarn feeder devices of this general type, in which at least one yarn is processed at each knitting feed. The yarn path extends from the yarn packages, mounted on an either stationary or rotating yarn carrier cage, via a plurality of yarn deflection points embodied by yarn guide elements such as eyes, to the yarn feeder which supplies the yarn to the individual needles in succession at any given knitting feed. The yarn feeder, embodied as a narrow, thin metal plate, conventionally has a yarn guide bore through which the yarn passes on its way to the needles. A yarn feeder of this kind must be disposed as close to the needles as possible yet without touching them, which would cause premature wear. Since in addition to the feeding of the yarn the yarn feeder has still other tasks to perform, namely to open half-closed needle latches and to avoid a latch closing during the run-in of the yarn, it is fabricated from hardened steel and equipped with a separating edge, with which if needed half-closed needle latches can be re-opened. In preventing the premature closure of the needle latches, a mechanical contact takes place between the latches and the yarn feeder, and on account of the relative movement between the needles and the yarn feeder, some needle wear is unavoidable. To keep this wear to a minimum, proper adjustment of a yarn feeder of this kind is critical; and it can be performed only by highly skilled operators.

Aside from this, threading the yarn into the small yarn guide bore of the yarn feeder is time-consuming and difficult, depending on the yarn material (crimping of the yarn caused by untwisting, or bunching, may occur), and can usually be accomplished only with the aid of auxiliary tools. Knots in the yarn, produced for instance by a yarn knotter, not infrequently become snagged in the yarn guide bore and come untied or break, especially if the yarn is deflected severely by the yarn feeder. A stitch, and hence a drop-off of the knit goods, and stoppage of the machine are the immediate consequences. Particularly in knitting with cotton yarns, there is the additional problem that the yarn feeder accumulates fluff, which leads to a constriction of the yarn guide bore, thereby hindering the yarn path. The end result, again, is yarn breakage and a drop-off of the knit goods.

THE INVENTION

It is the object of the invention to devise a yarn feeding and guide apparatus for knitting machines, and in particular circular knitting machines, which not only provides accurate feeding of yarn to the needles but excels in that the yarn is guided very gently, in a protected manner, in the vicinity of the yarn feeder, and there is no danger of impairment of the yarn path by fluff or the like, while the time-consuming threading of the yarn into small yarn guide bores of the like is dispensed with and needle wear can furthermore be reduced to a minimum.

Briefly, the yarn feeder comprises a body which, typically, is part-cylindrical or part-conical, formed on the circumference with at least one open yarn guide groove which has a root or bottom portion which is curved—as viewed in the direction of run or travel of the yarn—the at least one groove being oriented, upon attachment by suitable attachment means to the machine, to direct the path of yarn travel in a direction which is at an inclination with respect to the needles.

The yarn guide grooves makes it possible to feed the yarn within a relatively wide radius, so that there is less strain, to the needles. Since the yarn guide groove is continuously cleaned by the yarn itself, there is no danger of fluff accumulation or plugging caused thereby. Furthermore the yarn feeder can be manipulated easily without using special threading tools, because the yarn needs merely to be laid into the yarn guide groove.

Any knots in the yarn travel without difficulty over the bottom of the yarn guide groove, which has a relatively large radius of curvature. Since the yarn does not have to undergo any severe deflection, untying or tearing of the knots thereby is precluded. The gentle deflection of the yarn on the yarn feeder body also means that there is no notable increase in yarn tension, which regularly caused problems in known yarn feeders having a yarn guide bore and severe deflection of the yarn.

The bottom of the yarn guide groove may be curved in an arc, to enable the fabrication of the yarn feeder body as a simple lathe product. Depending on the position of the yarn feeder body with respect to the needle row, it may be advantageous for the yarn guide groove to be disposed extending at an inclination to the longitudinal axis of the yarn feeder body, so as to attain an optimal, maximally friction-free path of the yarn to the needles.

For double-yarn or multi-yarn knitting, the yarn feeder body may have at least two yarn guide grooves disposed beside one another, either in parallel planes or extending at different inclinations with respect to the longitudinal axis of the yarn guide body. The disposition may also be such that the yarn guide grooves converge in the direction of yarn runoff, so that the yarns are carried to the needles together.

The yarn guide grooves may be formed in a conical area of the circumference, or in substantially cylindrical areas of the circumference having identical or different diameters, of the yarn feeder body. In this manner, yarn guide grooves having a varying radius of curvature are available on the yarn feeder body, so that the optimal path of yarn travel for given knitting conditions can be selected.

The device securing the yarn feeder body may advantageously have a bore for a holder element, making it possible for the yarn feeder body to rotate and thus be adjusted properly in a simple manner. With a view to attaining the least possible friction on the yarn, it is advantageous if each yarn guide groove is defined by at least one, and preferably both side faces which converge in the manner of a wedge and by a curved face forming the groove bottom. The yarn feeder body may also be embodied in multiple parts, which on the one hand facilitates its manufacture and on the other presents the opportunity of easy adaptation of the yarn feeder to given requirements by combining various individual parts.

In a preferred embodiment, at least one yarn guide element, holding the yarn in the associated yarn guide groove, is associated with the yarn feeder body on the yarn run-in and/or run-off side. This yarn guide element assures, first, that the yarn travels properly and with the least possible friction through the yarn guide groove and, second, that as the tension on the yarn lessens the yarn will not fall out of the yarn guide groove. This yarn guide element may be an open yarn eye, which greatly facilitates manipulation. It is suitable for it to be disposed on the yarn feeder body, or the device securing that body, extending over the yarn guide groove and for it to be adjustable, as needed, along the associated yarn guide groove.

The eyes for yarn guidance existing in known yarn feeder devices, which are normally disposed in the yarn path in advance of the yarn feeder, not only cause an additional strain on the yarn, as already mentioned, but are also subject to the danger that they will become constricted with fluff, aside from the fact that it is relatively difficult to thread the yarn into them.

A remedy for this is possible here, in that two yarn guide elements are disposed spaced apart from one another in the yarn path directly before the yarn feeder body, these elements extending across the yarn path and being at least partially round in cross section. Each yarn rests on these elements on opposite sides, and the elements are kept apart from one another by the adjacent yarns. In a circular knitting machine, the two yarn guide elements are embodied by endless rings extending along the circumference of the machine. These yarn guide elements, or yarn guide rings, determine the direction of yarn travel without requiring yarn eyes to this end. The yarns are easily threaded, and the yarn guide elements or rings are continuously cleaned by the yarns themselves. Since the yarns traveling over them are capable of oscillating slightly back and forth, the yarns do not cut into them, and a wear-resistant surface treatment of these elements can often be dispensed with.

As has already been mentioned, considerable needle wear is occasioned by the contact between the needle latches and one edge of the yarn feeder that occurs in the yarn feeders of known yarn feeder devices and is the product of the additional function of these yarn feeders as needle latch openers. In the novel yarn feeder and guide device, such mechanical contact between the needle latches, or other parts of the needles, and the yarn feeder body can be eliminated entirely. The yarn feeder body is advantageously disposed in the vicinity of a part of the needle raising cam that is located in advance of the maximally raised, or projected position, such that the taut yarn that extends from the yarn guide groove to the needle which draws the new yarn loop through the old loop. i.e., the stitch forming needle, acts as the latch opener for the needles that are being raised, and the latches both of the fully raised needles and of the needles that are being lowered are kept in the open position by this yarn.

The yarn must naturally be kept sufficiently taut during this process. However, since during drop-off of knit goods the tension on the individual yarns either lessens or collapses entirely, it is advantageous for the yarn to be held taut by a yarn supply device or fournisseur, which is driven by a selectively adjustable controlled drive mechanism. This controlled drive mechanism may be adjusted manually in such a manner that the yarn supply device temporarily delivers a reduced quantity of yarn, so by leaving the needle cam adjustment unchanged, an increase in yarn tension is attained. One or two rotations of the machine later, all the needles have again formed loops, and the controlled drive can be set back to the previous quality, which can also be done while the machine is in operation.

Yarns having a high degree of twist or kinking, "live" yarns, when losing their tension, may show a tendency of leaving their yarn guide groove of the yarn feeder body and getting behind the needle hooks or into a different yarn guide groove of the yarn feeder body. This may impede proper operation of the circular knitting machine or cause defects in the knitwear.

Especially for these cases, a somewhat modified embodiment of the yarn feeder will be of advantage. With this embodiment, the yarn feeder is provided with a plate which extends laterally from the yarn feeder body and forms a 90°-angle with the longitudinal axis of the yarn feeder body. The plate is formed on one of its faces with a recess or depression which is defined by a bottom surface and, at least partially, by a generally triangle-shaped boundary which, at least approximately and with a small clearance, follows the contour of the needle envelope curve in the region where the needles are in raised positions for catching the yarn with their hooks. Upon attachment on the machine, the plate is located with the bottom surface of said recess extending in a small distance behind the raised needles.

The plate allows a simple adjustment of the yarn feeder body with respect to the needles by using a feeler gauge for locating the bottom surface of said recess in a small predetermined distance from the backsides of the needles. In a similar way, it is easy to bring the yarn feeder body in its exact position with respect to the needles by correctly positioning the boundaries of said recess with respect to the needle envelope curve.

The boundary of the recess which, by a small distance, envelops the needle envelope curve, acts as a security deflecting edge, preventing the yarn from getting behind the needle hooks when the yarn is slackened.

Because of the small clearance between the back sides of the needles and the bottom surface of said recess, no fluff and lint can accumulate in the recess, the moving needles themselves exerting a self-cleaning action in so far.

The yarn, in accordance with a feature of the invention, if fed obliquely, or at an inclination, with respect to a plane perpendicular to the plane in which the needles move during knitting operation. This inclined feed can be obtained by inclining the yarn guide grooves on the yarn feeder body which, typically, is a body of rotation, with respect to the rotational axis thereof; by inclining the axis of the yarn feeder body with respect to said plane; or by lightly bending the needles forward, that is, in the direction of the latch or open face of the hook, by engaging the needles with a cam track formed on a plate secured to the machine and engaged by the needles as they are raised over the verge or tip of the slot or trick in which the needles operate. The plate and the feeder body can be secured together and jointly attached to the machine.

Reference has been made to the "plane in which the needles move". In a circular knitting machine, this would not be a flat plane but, rather, a theoretical curved surface due to the motion of the machine. For purposes of explanation, however, the term "plane" may be used, since it is approximately, although not mathematically, correct.

The plate can be provided with a short protruding cam track for resiliently deflecting the hook portions of the needles which are about to catch the yarn in a radially outwardly direction towards the taut yarn, resulting in a more secure insertion of the yarn.

The plate may be provided, on its yarn run-off side, with an obliquely disposed yarn deflecting face, by which the yarn, if inadverently coming free from its yarn guide groove, is deflected towards the needle hooks. Furthermore, this yarn deflection face makes manual threading-in of the yarn easier when the machine is restarted subsequent to a malfunction of the machine, which had caused the knitgoods to be thrown off the needle hooks.

Each of the yarn guide grooves in the yarn feeder body is usually defined by two side faces which are inclined with respect to the longitudinal axis of the yarn feeder body and which converge towards the bottom face of said groove. In order to prevent kinky yarns from leaving their yarn guide groove and from mounting on a side face of their groove, the yarn feeder body can be further improved by providing the yarn feeder body with at least one yarn guide groove which is defined, on its one side close to the needles, by a plane side face that extends perpendicularly to the longitudinal axis of the yarn feeder body. The opposite side face of this yarn guide groove is inclined with respect to the longitudinal axis, thus assisting the yarn in smoothly entering the yarn guide groove.

DRAWINGS

FIG. 3 is a schematic, partially cutaway plan view of the yarn feeder device of FIG. 2;

FIG. 4 is a fragmentary, schematic view of the apparatus of FIG. 3, taken along the line IV—IV;

FIG. 5 is a fragmentary view, taken along the line V—V of FIG. 3, of a needle belonging to the apparatus shown in FIG. 3;

Figure 13:
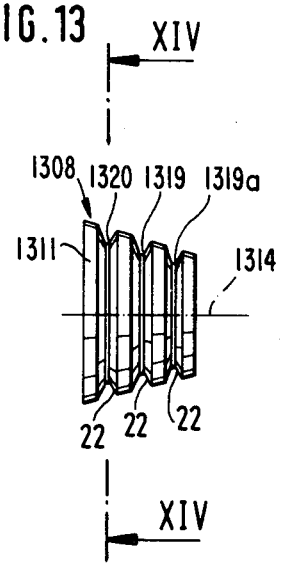
FIG. 13 is a side view, on a different scale, of a different form of embodiment of a yarn feeder, intended for the yarn feeder device according to FIG. 1.
Figure 14:
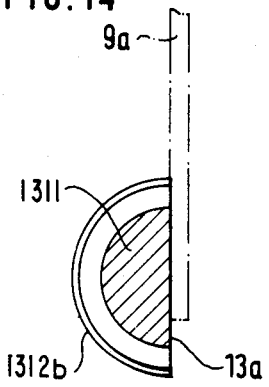
FIG. 14 shows the yarn feeder of FIG. 14, in a section taken along the line XIV—XIV of FIG. 13.
Figure 15:
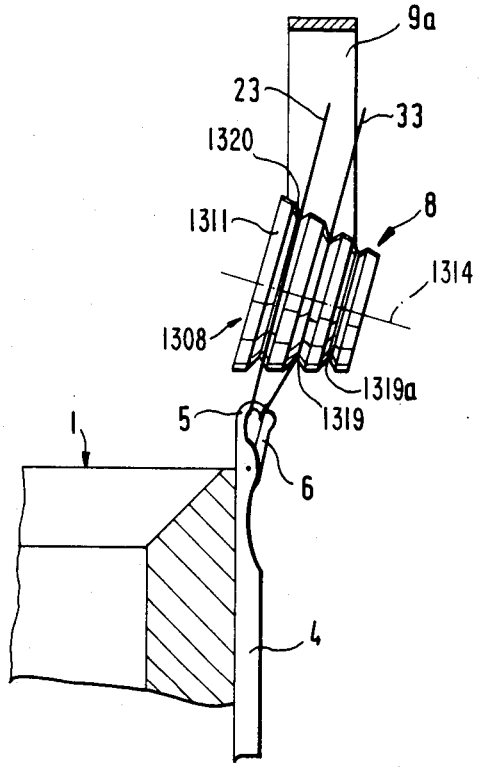
Figure 16:
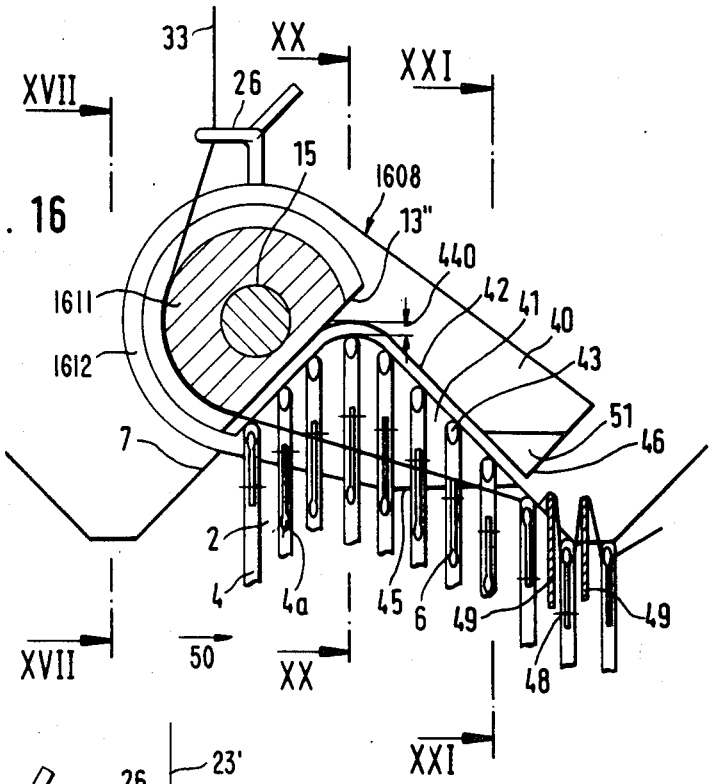
Figure 17:
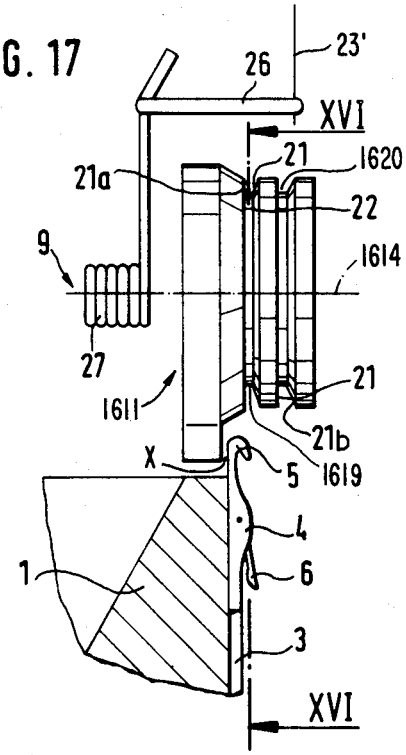
Figure 18:
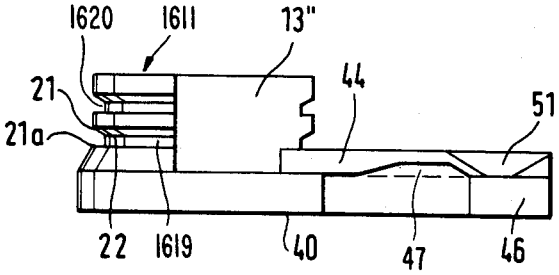
Figure 19:
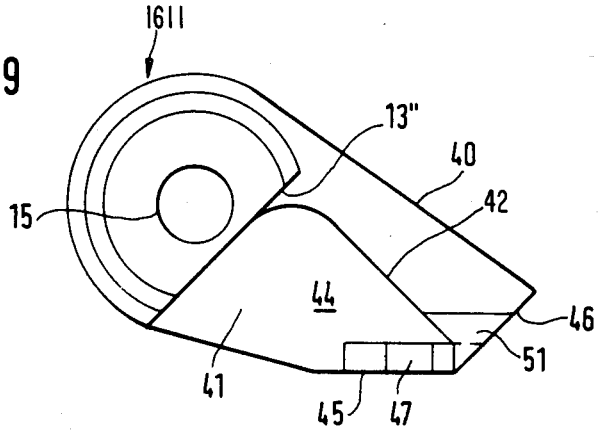
Figure 20:
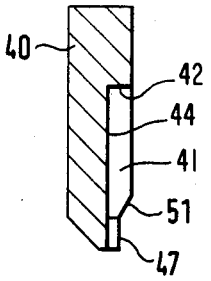
Figure 21:
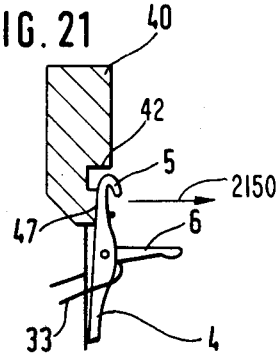

FIG. 15, in a fragmentary side view, shows a yarn feeding and guide device according to the invention having the yarn feeder according to FIGS. 13, 14;

FIG. 16 shows a modified embodiment of a yarn feeder guide device according to the invention, in a fragmentary view, taken along the line XVI—XVI of FIG. 17;

FIG. 17 shows the yarn feeder device of FIG. 15 in a fragmentary view, taken along the line XVII—XVII of FIG. 16;

FIG. 18 is a side view of the yarn feeder of FIG. 16;

FIG. 19 is a plan view of the yarn feeder of FIG. 18;

FIG. 20 is a side view of the plate of the yarn feeder of FIG. 16, taken along the line XX—XX of FIG. 16, and FIG. 21 is a side view of the yarn feeder of FIG. 16, taken along the line XXI—XXI of FIG. 16.

DETAILED DESCRIPTION

Figure 1:
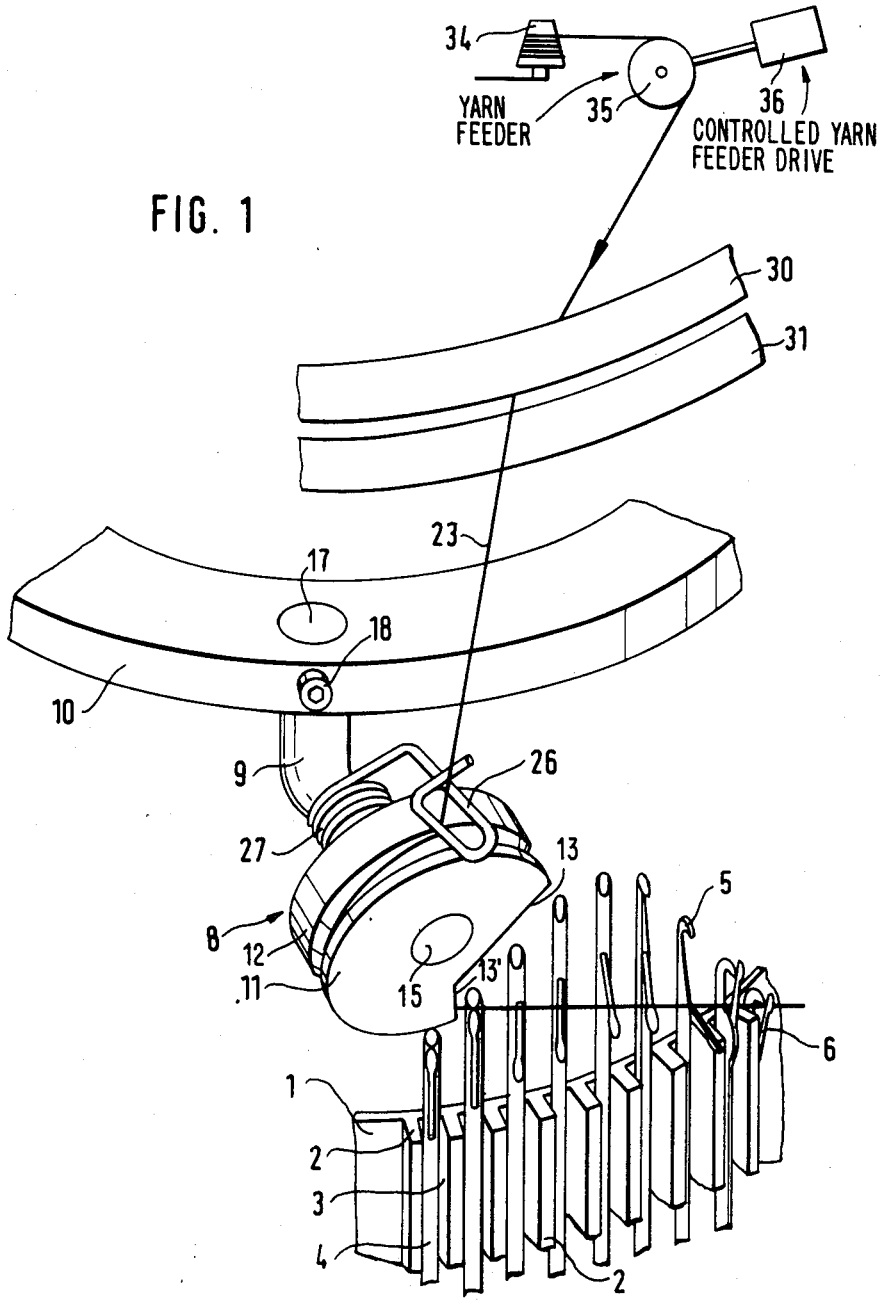
FIG. 1 shows a yarn feeder and guide device according to the invention in a perspective view and in fragmentary form.
Figure 2:
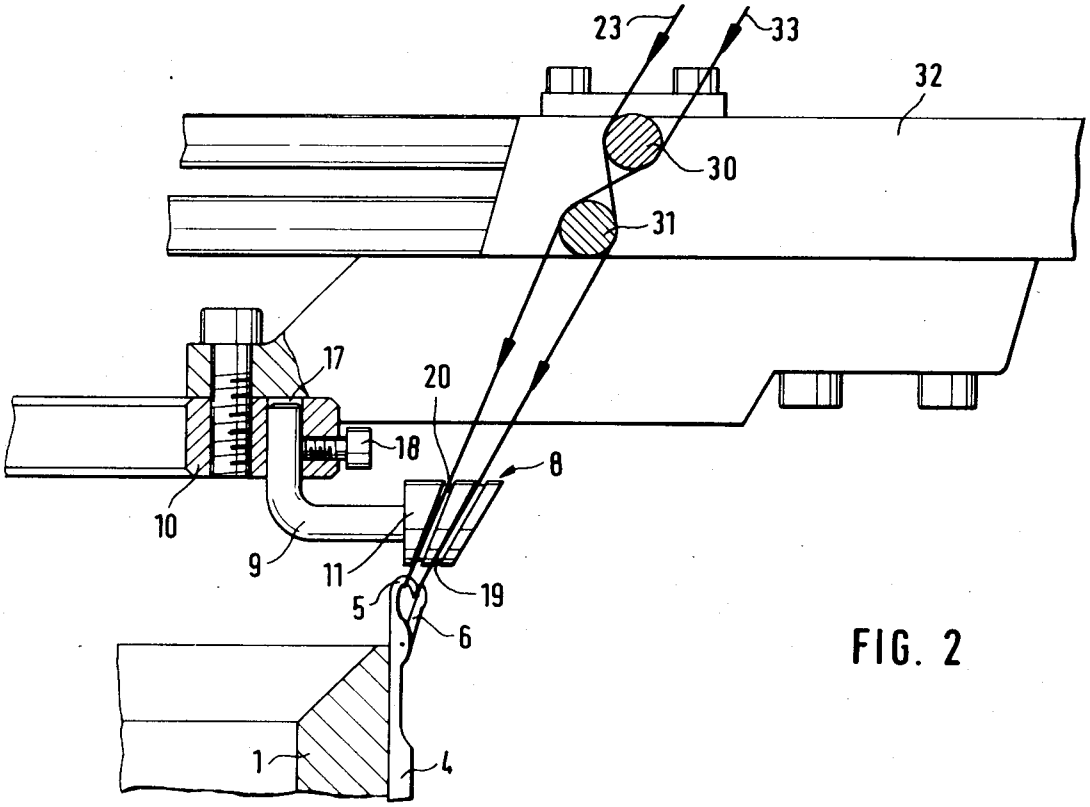
FIG. 2 shows the yarn feeder device of FIG. 1, partly in a section and in a side view.
Figure 6:
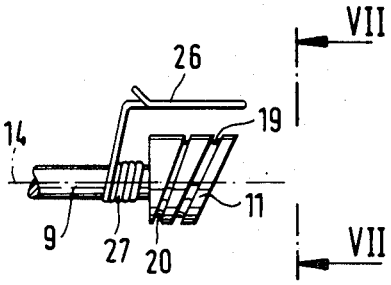
FIG. 6 is a side view, approximately natural size, of the yarn guide of the apparatus of FIG. 3.
Figure 7:
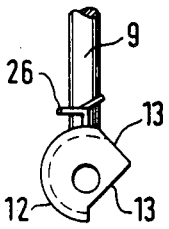
FIG. 7 is an end view of the yarn feeder of FIG. 6, taken along the line VII—VII of FIG. 6.
Figure 8:
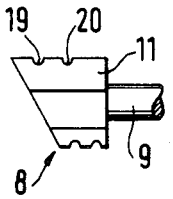
FIG. 8 is a side view of the yarn feeder of FIG. 6, rotated by 180°.
Figure 9:
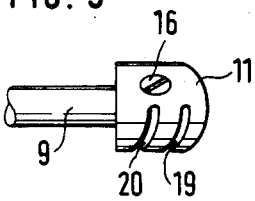
FIG. 9 is a plan view of the yarn feeder of FIG. 6, without a yarn guide element.
Figure 10:
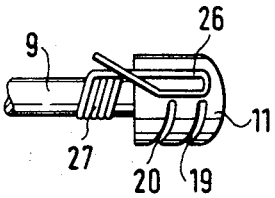
FIG. 10 is a plan view of the yarn feeder of FIG. 6 with the yarn guide element.

FIGS. 1 and 2 provide a fragmentary view of a novel yarn feeding and guide device for a circular knitting machine, showing the feeding of yarn to only a single knitting feed. The package cage or holder and so forth are not otherwise shown in detail.

Slots 3, defined by parallel ribs 2, as well known, are formed at the circumference of the revolving needle cylinder 1, and latch needles 4 are supported in a longitudinally displaceable manner in these slots 3, being operated by needle cams, not shown in detail. Each of the latch needles 4 has a hook 5 and a pivotably supported latch 6, in a manner known per se.

To the side of the needle head curve indicated at 7 in FIG. 3, there is a yarn feeding and guide device, or feeder 8, which is secured by means of a holder bracket 9 to a holding ring 10 of the circular knitting machine. The yarn feeder 8, in the form of embodiment shown in FIGS. 1–10, has a part-cylindrical yarn feeder body (FIG. 3). The cylindrical circumferential area 12 of body 11 extending over an angle of approximately 180°. An angular circumferential area is formed by two faces 13 and 13' at right angles to one another. A receiving bore 15 is formed in the yarn feeder body 11, coaxially with the longitudinal axis 14, and with this bore 15 the yarn feeder body 11 is mounted upon one arm of the approximately L-shaped holder element 9 (FIG. 4). The feeder body 11 is firmly fixed in a given position by means of a recessed set screw 16 which passes through one of the faces 13, 13', namely face 13 (FIG. 3).

The holder bracket 9 itself is held in a corresponding bore 10 of the holding ring 17 in the manner shown in FIG. 2, being pivotable about a vertical axis, and fixed in a given position by a locking screw 18.

In the cylindrical area 12 of the circumference, the yarn feeder body 11 has two yarn guide grooves 19, 20, which as shown in FIG. 4, for example, are located in planes that extend obliquely with respect to the longitudinal axis 14. The guide grooves 19, 20 thus have different inclinations relative to the longitudinal axis 14 of the yarn feeder body 11, such that they are disposed convergently in the direction of yarn run-off, or in other words toward the needles 4. Each of the yarn guide grooves 19 is defined by side faces 21, which converge in a wedge-like manner, and by a face 22 (FIG. 3), forming the groove bottom and preferably being curved in an arc, the width of which is matched to the width of the yarn 23 traveling through it, so that the yarn is prevented from becoming caught in the yarn guide groove 19 or 20.

On the yarn run-in side of the yarn feeder 8, there is a yarn guide element in the form of an open eye 26 (FIG. 1), which overlaps both yarn guide grooves 19, 20 and is shaped from a piece of wire anchored at 27 by being wound onto the holder bracket 9. The winding 27 makes it possible to adjust the yarn guide element 26 selectively along the cylindrical area 12 of the circumference, or in other words along the yarn guide grooves 19, 20.

In the yarn path directly in advance of the yarn feeder body 11, two yarn guide elements are disposed spaced apart from one another and extending across the yarn path. These elements, having a circular cross section, are formed as two endless rings 30, 31 extending along the circumference of the machine. The two rings 30, 31 are coaxial with the machine and spaced apart from one another and are held in place on the machine on a holding part 32 as shown in FIG. 2. The two yarns 23, 33 being supplied wrap partway around them in such a manner that each yarn 23 or 33 rests on opposite sides of the two rings 30, 31, and in the region between the two rings 30, 31 the two yarns 23, 33 cross and are thus kept spaced apart and threaded into the two yarn guide grooves 19, 20 of the yarn feeder 8 which follows.

OPERATION

The yarns 23, 33 (FIG. 2) each arriving from a yarn package—one of which is shown, reduced in scale, at 34 in FIG. 1—are each guided via a respective positive yarn delivery unit 35, or fournisseur, which substantially comprises a rotatably supported drum about which the yarn is wrapped in a plurality of windings, thereby establishing a slip-free coupling between the yarn and the drum. The drums of all the delivery units 35 of the various feeds of the circular knitting machine are driven by a common gear belt, as well known, and it is driven in turn via a controlled drive 36 the significance of which will be explained later.

The two yarns 23, 33, held at the required tension by the respective yarn delivery units 35, being held separately by the two endless rings 30, 31, are transported to the yarn guide grooves 19, 20 of the yarn feeder 8. The yarns 23, 33 are capable of oscillating laterally to some extent on the two rings 30, 31, thereby avoiding cutting into the material making up the rings and avoiding undesirable accumulations of fluff.

The two yarns 23, 33 are diverted, on the curved bottom 22 of the yarn guide grooves 19, 20, in a direction extending obliquely with respect to the needles 4 (see FIG. 4). The resiliently anchored yarn guide element 26 (FIG. 1) at the yarn run-in side of the yarn feeder 8 assures that the yarns cannot escape from the yarn guide grooves 19, 20, even if the tension on the yarn should decrease.

As shown particularly in FIG. 3, the yarn feeder body 11 is disposed in such a manner with respect to the needle bead envelope curve 7 that, first, mechanical contact between the needles 4 or their parts and the yarn feeder body 11 is precluded, and, second, the taut yarn extending toward the needle 4*a* forming the stitch, that is, the needle which draws the new loop through the old, upon movement to the knock-over position, acts as a latch opener for the needles 4 executing the raising, or projecting, movement on the raising branch 7*a* of the needle envelope curve 7, while on the other hand the latches 6 of the fully projected needles 4, as well as of the needles 4 executing the lowering movement along the branch 7*b* of the needle cam curve 7, are held by this taut piece of yarn in the open position, without requiring any mechanical intervention with the needles 4 or latches 6.

In order to assure reliable opening of the latches 6, these latches are extended somewhat in the vicinity of their latch spoon 37 opposite the tip of the needle hook, as shown in FIG. 4, producing a small V-shaped space 38 defined on one side by the inside of the spoon and on the other by the outside of the hook, in the vicinity of the tip of the hook. When the needles 4 are raised in accordance with the branch 7*a* of the needle envelope curve 7, the taut piece of yarn extending between the needle 4*a* and the yarn feeder body 11 reaches this V-shaped space 38, so that in the course of the continuing raising or projecting movement the latches 6 are automatically moved into the opened position. To this end it is of course necessary that the radial position of the yarn feeder body 11 also be adjusted with respect to the needle cylinder 1 in such a manner that the taut piece of yarn mentioned here will rest on the front of the hook 5 and of the shaft of the needles 4.

As the raising movement continues, the taut piece of yarn 23 comes to rest against the opened latch 6, as shown in FIG. 5, with the result that the needle latch 6 is automatically kept open during the entire raising movement, and during the lowering movement of the needles the latch 6 cannot close until the yarn has been caught in the needle hook 5.

If a drop-off of the knit goods from the needles 4 should occur, for instance if the yarn breaks, the result is a collapse of the yarn tension. The piece of yarn that would otherwise be taut between the needle 4*a* and the yarn feeder body 11 can then no longer fulfill its function as a latch opener. The controlled drive 36 is used to restart the fabric, and it can now be adjusted manually in such a manner that the yarn delivery units 35 artificially increase the tension on the yarn, held firmly on its end at the needles, so that after a few revolutions of the machine, the machine will automatically knit a few rows of loops. The controlled drive 36 is then reset for normal operation.

Further forms of embodiment of the feeding and guide device, or the yarn feeder 8 are shown in FIGS. 11–21.

Identical elements in the forms of embodiment shown in FIGS. 11–21 are identified by the same reference numerals as in FIGS. 1–10 and need not be described again.

Figure 11:
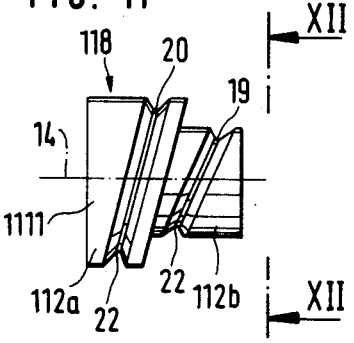
FIG. 11 is a side view, on a different scale, of a different form of embodiment of a yarn feeder, intended for the yarn feeder device according to FIG. 1.
Figure 12:
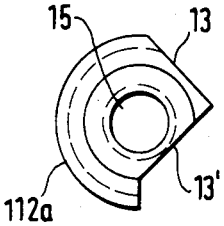
FIG. 12 is a side view of the yarn feeder according to FIG. 11, taken along the line XII—XII of FIG. 11.

The yarn feeding or guide device 118, shown in FIGS. 11 and 12, has a yarn feeder body 1111 with two substantially semi-cylindrical circumferential areas 112*a*, 112*b*, which are formed with different diameters. In each of the circumferential areas 112*a*, 112*b*, one yarn guide groove 20 and 19, respectively is provided, the bottom faces 22 of which thus have a different radius of curvature, which depending on the particular properties of the circular knitting machine is suitable for providing yarn deflection and delivery with as little friction as possible.

In the form of embodiment shown in FIGS. 13–15 for a yarn feeding or guide device 1308, a body 1311 is provided which has three yarn guide grooves 1320, 1319, 1319*a* formed, spaced apart from one another, on a semi-conical circumferential area 1312*b* of the yarn feeder body 1311. As a result, the radii of curvature of the bottom faces 22 of the yarn guide grooves 1320, 1319, 1319*a* are different from one another. While in the form of embodiment according to FIGS. 11, 12 the two yarn guide grooves 19, 20 are located in planes extending obliquely with respect to the longitudinal axis 14 at different inclinations, and converging toward the yarn run-off side, the yarn guide grooves 1320, 1319, 1319*a* of the form of embodiment shown in FIGS. 13–15 are located in parallel planes which extend at right angles to the longitudinal axis 14. The yarn feeder 1308 is mounted obliquely with its axis 1314 inclined with respect to a line perpendicular to the needle shafts. As shown in FIG. 15, with the oblique position of the yarn feeder body 1311 shown there, the two yarns 23, 33 are optimally delivered to the needle hook 5 of the needle 4 shown..

The yarn feeder bodies 11 (FIGS. 1–10), 111 (FIG. 11), 1311 (FIG. 13), as part of the yarn feeding and guiding devices 8, 118, 1308 and 1608 (FIG. 16) which are shown in four embodiments, may either be one-piece products of a screw machine or lathe, or injection molded parts, or they may be designed in multiple parts; in that case, the individual parts may be formed as discs, for example, and secured to one another at their end faces. In this manner, the yarn feeder can be adapted to various possible situations by interchanging a few individual parts.

The novel yarn feeding and guide device has been described above in connection with a circular knitting machine. In principle, it is suitable for both circular and flat bed knitting machines. In the latter case, the yarn guide elements 30, 31 take the form not of endless rings, but rather of straight rods having a round cross section.

As explained above, the yarn feeder body 11 may be secured by means of a central receiving bore 15 and a cylindrical holder element 9 protruding into it. The attachment device may also be embodied differently, as shown in FIGS. 14, 15. There a securing bracket 9*a* made of flat material is provided, which is firmly screwed onto one face 13*a* of the yarn feeder body 11, by way of example, and arranged for being fastened to the holder ring 10 or the like on the machine.

In the form of embodiment shown in FIGS. 16 to 21, the yarn feeding and guide device 1608 comprises a yarn feeder body 1611 with a cylindrical circumferential area 1612, extending over an angle of more than 180° and with a plane face 13″ intersecting the cylindrical circumferential area 1612. In the cylindrical circumferential area 1612, two yarn guide grooves 1619, 1620 are provided which are located in planes that extend at right angles with respect to the longitudinal axis 1614. Yarn guide groove 1619, which is close to the needle hooks 5 and through which yarn 33 is guided, is defined on its left side, as shown in FIG. 17, by a plane side face 21*a*, which is disposed at right angles to the longitudinal axis 14. The opposite side face 21 of the yarn guide groove 19 extends obliquely with respect to the longitudinal axis 14 and converges towards the groove bottom 22.

The second yarn guide groove 1620, which is intended for guiding a plating yarn 23′, is defined by two sidefaces preferably, converging in a wedgelike manner toward the bottom of the guide groove 1620. It is desirable that at least one side surface, shown at 21*b* is inclined inwardly toward the bottom of the groove 1620.

The yarn feeder body 1611 is mounted with one of its end faces on a small plane plate 40, which extends laterally from the longitudinal axis 1614 and in a general direction towards the needles 4. The yarn feeder body 1611 and the plate 40 may be a one-piece product or, alternatively, they may be assembled of separate elements, which are connected to each other and mounted on the holder bracket 9 (shown only schematically in FIG. 17). In the latter case, the yarn feeder body 1611 can also be adjustably mounted on the plate 40.

The plate 40 is provided on its surface facing the needles 4, as seen in FIG. 19 with a recess 41 that opens to the lower edge of the plate 40 and that is defined by a triangle-shaped boundary 42, which follows, at least approximately, the contour of the needle envelope curve 7 in a zone where the needles 4 are being raised for catching the yarns 23 and 33 (see FIG. 16). The boundary 42 is located by a small distance, as indicated with 440, from the needle heads 43, in order to prevent the needle heads 43 from touching the boundary 42, even when the knitting machine is operated at high speed.

On the side of the yarn feeder body, the boundary 42 is defined by the face 13″ of the yarn feeder body 1611. In the present case, the face 13″ is plane, but alternatively the face 13 could be curved in accordance with the contour of the corresponding branch of the needle envelope curve 7.

The boundary 42 of the recess 41 is defined in the area adjacent the yarn feeder body 1611 by a side face of the recess 41, which extends at right angles to the bottom surface 44 of the recess 41. The bottom surface 44 is located by a small distance x behind the raised needles 4, as this is clearly shown especially in FIG. 17.

In an alternative embodiment, the recess 41 could also be defined by the plane plate 40 and a boundary 42 in the form an upright rib, which is e.g. soldered to the upper face of the plate 40.

The height of the boundary 42, as seen at right angles to the bottom surface 44 of the recess 41, is approximately equal to the width of the backs of the needle hooks 5 plus the distance x between the needle heads 43 and the bottom surface 44.

The distance between the bottom surface 44 and the plane sideface 21*a* of the yarn guide groove 1619, as seen at right angles to the bottom surface 44, is also approximately equal to the width of the backs of the needle hooks 5 plus the beforementioned distance x.

The bottom surface 44 of the recess 41 is a plane face. It could, however, also be curved in accordance with the curvature of the needle cylinder 1 so that the distances x between the bottom surface 44 and each of the needles 4 reaching into the recess 41 would be the same.

As shown in FIG. 17, the plate 40 extends with a horizontal end face 45 (FIG. 19) to a location which is close to the upper edge of the needle cylinder 1 without touching the needle cylinder 1, however. Over the length of this end face 45, the plate 40 is parallel to the edge of the needle cylinder 1. Adjacent the end face 45, the plate 40 is provided on its yarn run-off side with an obliquely disposed yarn guide face 46, which serves for deflecting the yarn in a direction towards the needle hooks 5 and which ends in a location above the needles 4 somewhere near the loop forming point, as indicated at 48 in FIG. 16. The oblique face 46 assists in proper yarn placement upon start-up.

Further, the face deflects yarn towards the needle hooks if—due to malfunction, for example, or loss of yarn tension—the yarn should escape from groove 19 or 20. In normal operation, face 46 has no operative function. FIG. 16 shows two loop forming sinkers 49, which are slidably mounted in the dial of the knitting machine and which are only representative for the row of sinkers which are evenly distributed around the circumference of the dial. As clearly seen in FIGS. 1 and 16, the path of the yarn 33 extends at an inclination with respect to needle movement, and across the needles.

As illustrated especially in FIGS. 18 to 21, the plate 40 is provided with a short protruding cam track 47, which is located on the bottom surface of the recess 41 and close to the edge of the plate 40 that faces the needle cylinder 1. The length of the cam track 47, as seen in the circumferential direction of the needle cylinder 1, is at least about one needle pitch. In the present case, the forward end of the cam track 47 is in a distance of about two needle pitches before the needle 4, which is just about to catch the yarn and which is designated with 4*a* in FIG. 16. The arrow 50 indicates the sense of rotation of the needle cylinder 1. Cam track 47 has been omitted from FIG. 16 for clarity of presentation.

The needles engage the cam track 47 with the backsides of their hook portions. The needles 4 are elastically deflected in a radially outwardly extending direction, see arrow 2150, FIG. 21, and in this way they are moved with their hooks 5 towards the taut yarn 33, thereby enhancing their yarn catching function. When leaving the cam track 47, their inherent resiliency will bring back the needles 4 into their original position of FIG. 17, and as a consequence, the forming of the yarn loops will not be adversely influenced.

The plate 40 is formed, adjacent the right-side branch of the boundary 42 (FIG. 16) with an inclined face 51.

Since the plate 40 extends with the bottom surface 44 of its recess 41 in a small distance x behind the raised needles 4 (FIG. 17), and since it envelops with a small clearance, with its boundary 42, the needle heads 43 (FIG. 16), which are raised in accordance with the needle envelope curve 7, the thread 33 is prevented from entering into the space behind the needle hooks 5. The needles 4, which are moving in a small distance x from the bottom surface 44 of the recess 41, provide, furthermore, a self cleaning effect for the recess 41, with the result that fluff and lint are safely prevented from collecting in the recess and forming deposits therein.

On its way to the needle hooks 5, the yarn is very gently treated; there is no metallic contact of the needle latches 6. As a consequence, there is no danger of inadvertently bending the needle latches 6. In case that the knit goods are inadvertently dropped off the needle, the knitting machine can be restarted without previously opening the needle latches 6 by hand. If a defective needle with a broken needle butt should remain stationary in a raised position, the inclined branch of the boundary 42 will automatically return this needle into its lower position where it can cause no harm.

We claim:

1. Yarn feeding and guide device in combination with a knitting machine, particularly a circular knitting machine, wherein the needles are reciprocated in a predetermined direction, and the yarn, supplied from a yarn package (34) at a predetermined tension, is being fed to the needles (4) of the knitting machine at a feed position, wherein, in accordance with the invention, the yarn feeding device comprises a body having an at least part-circular circumference;

at least one open yarn guide groove, which has a root or bottom portion which is curved—as viewed in the direction of the run or path of the yarn—formed in said at least part-circular circumference;

means for securing said body to the machine;

means (26) for guiding the yarn to the at least one groove;

at least one of said grooves being located and oriented upon attachment of the body on the machine, to deflect the yarn in the groove in a curved path about at least a portion of said-circular circumference, and to direct the path of travel of the yarn, upon leaving said groove, in a direction which is across the needles and at an inclination with respect to the direction of reciprocating movement of the needles (4), a plate laterally extending from said at least part-circular body and positioned at an angle of about 90° with the longitudinal axis of said body, said plate being formed with a recess on a face thereof which is adjacent said at least one groove, said recess (41) being defined by a bottom surface (44) and, at least partially, by a generally triangle-shaped boundary which, at least approximately and with a small clearance, follows the contour of the needle envelope curve (7) in the region where said needles (4) are in raised positions for catching said yarn with their hooks, and wherein said securing means, upon attachment on the machine, positions said plate with said bottom surface of said recess in the plate located by a small distance (x) behind said needles (4) when the needles are moving in raising direction and positioned prior to a yarn insertion position.

2. Yarn feeding and guide device according to claim 1, wherein said boundary (42) extends at right angles to said bottom surface (44).

3. Yarn feeding and guide device according to claim 1, wherein the height of said boundary (42), as seen perpendicularly to said bottom surface (44), is approximately equal to the width of the back of the hooks (5) of said needles plus said small distance (x) between the back sides of said needles and said bottom surface (4).

4. Yarn feeding and guide device according to claim 1, wherein the distance between said yarn guide groove (19) and said bottom surface (44), as seen perpendicularly to said bottom surface, is approximately equal to the width of the hooks (5) of said needles plus said small distance (x) between the back sides of said needles and said bottom surface (44).

5. Yarn feeding and guide device according to claim 1, wherein said body (1611), adjacent its circumferential area (1612), wherein said yarn guide groove (19) is formed, is provided with a face (13'') which follows at least approximately the contour of the neighboring branch of said needle envelope curve (7).

6. Yarn feeding and guide device according to claim 1, wherein said face (13'') of said body (1611) defines at least partially laterally said recess (41).

7. Yarn feeding and guide device according to claim 1, wherein said bottom surface (44) is plane.

8. Yarn feeding and guide device according to claim 1, wherein said plate (40) extends, with a portion (45), into the close vicinity of the needle carrier (1) of said knitting machine, said portion (45) being substantially parallel to the edge of said needle carrier.

9. Yarn feeding and guide device according to claim 1, wherein said yarn guide groove lies in a plane which is substantially parallel to said bottom surface (44).

10. Yarn feeding and guide device according to claim 1, wherein said yarn guide groove (19) is defined, on its side facing said plate (40), by a plane side face (21*a*)

which extends at right angles to the longitudinal axis (14) of said body (11).

11. Yarn feeding and guide device according to claim 1, wherein said plate is provided with an obliquely disposed end face (46) on its yarn-off side, said end face facing said needles.

12. Yarn feeding and guide device according to claim 1, wherein said body (1611) and said plate (40) are adjustably secured together.

13. Yarn feeding and guide device according to claim 1, including a short protruding cam track (47) formed on said plate at the bottom of said recess, extending essentially transversely to said direction of reciprocating movement of said needles, said cam track being located to engage needles which are in yarn insertion position and catch the yarn, said cam track cooperating with said needles for resiliently deflecting the hook portions of said needles in said yarn insertion position in a radially outward direction with respect to said bottom surface.

14. Yarn feeding and guide device according to claim 13, wherein said cam track (47) extends over at least one needle pitch.

15. Yarn feeding and guide device according to claim 1, wherein said body comprises a solid body.

16. Yarn feeding and guide device according to claim 1, wherein the yarn feeder body is disposed in the vicinity of the portion of the needle envelope curve (7) in the raising portion of the longitudinal needle projection located prior to the maximally raised needle position in such a manner that the taut yarn extending obliquely from the yarn guide groove to the stitch or loop forming needle (4*a*) forms the latch opener for the needles (4) executing the raising movement, said obliquely extending yarn holding the latches (6) of the fully raised needles, and of the needles executing the withdrawing or lowering movement, in open position.

17. Yarn feeding and guide device according to claim 15, in combination with a knitting machine having a yarn delivery unit or fournisseur (35);

wherein an adjustable controlled drive (36) for the yarn delivery or fournisseur is provided, to hold the yarn taut.

18. Yarn feeding and guide device according to claim 1, wherein at least two yarn guide grooves are provided, located axially adjacent each other.

19. Yarn feeding and guide device according to claim 18, wherein the at least two yarn guide grooves are located in parallel planes.

20. Yarn feeding and guide device according to claim 1, wherein the yarn feeder body is formed with a receiving bore for the securing means;

and the securing means comprises a holder element attached in the receiving bore.

21. Yarn feeding and guide device according to claim 1, wherein the at least one yarn guide groove is defined by a groove bottom and by at least one side face converging in wedge-like fashion towards the curved groove bottom.

22. Yarn feeding and guide device according to claim 1, wherein the yarn feeder body comprises a multi-element structure.

23. Yarn feeding and guide device according to claim 1, wherein said means (26) for guiding the yarn to said at least one groove comprises a yarn guide element (26) guiding the yarn to the at least one yarn guide groove and located at the yarn run-in side.

24. Yarn feeding and guide device according to claim 23, wherein the yarn guide element is an open yarn eye (26).

25. Yarn feeding and guide device according to claim 23, wherein the yarn guide element (26) is located on the yarn feeder body on said securing means and overlapping the at least one yarn guide groove.

26. Yarn feeding and guide device according to claim 25, wherein the yarn guide element is secured on said securing means and adjustable with respect to said at least one groove.

27. Yarn feeding and guide device according to claim 1, wherein the yarn feeder body has at least two yarn guide grooves disposed axially adjacent each other;

and wherein two yarn guide elements of at least partially round cross section are provided, located in the yarn path from the yarn package and positioned immediately in advance of the yarn feeder body, spaced apart from one another and extending across the yarn path, each yarn running across opposite sides of the elements to keep the yarns separate from one another.

28. Yarn feeding and guide device according to claim 27, wherein the knitting machine comprises a circular knitting machine;

and wherein said two yarn guide elements comprise endless rings extending along the circumference of the machine.

* * * * *